US010434640B1

(12) United States Patent
Lennon

(10) Patent No.: US 10,434,640 B1
(45) Date of Patent: Oct. 8, 2019

(54) TOOL STORAGE SYSTEM

(71) Applicant: Thomas Patrick Lennon, Ojai, CA (US)

(72) Inventor: Thomas Patrick Lennon, Ojai, CA (US)

( * ) Notice: Subject to any disclaimer, the term of this patent is extended or adjusted under 35 U.S.C. 154(b) by 0 days.

(21) Appl. No.: 15/732,649

(22) Filed: Dec. 7, 2017

(51) Int. Cl.
*B25H 3/04* (2006.01)
*A47F 5/06* (2006.01)

(52) U.S. Cl.
CPC *B25H 3/04* (2013.01); *A47F 5/06* (2013.01)

(58) Field of Classification Search
CPC ..... A47F 5/05; A47F 5/06; B25H 3/04
See application file for complete search history.

(56) References Cited

U.S. PATENT DOCUMENTS 1,704,122 A 3/1929 Cohen
2,565,625 A 8/1951 Phelon
2,697,804 A 12/1954 Phelon
2,964,201 A 12/1960 Huffman
3,229,820 A 1/1966 Works
3,734,301 A 5/1973 Rastocny
4,953,696 A 9/1990 Huang et al.
5,221,006 A 6/1993 Plumlee
5,221,132 A 6/1993 Combs
5,337,904 A * 8/1994 Goldberg ..... A47F 5/04 211/26.1
5,630,517 A 5/1997 Maznik
5,672,145 A 9/1997 Pollington
6,062,735 A * 5/2000 Ward ..... F16C 23/084 384/492
6,182,839 B1 2/2001 Robbins
6,273,277 B1 * 8/2001 Geldenhuys ..... B25H 3/025 211/115
6,454,231 B1 * 9/2002 Fischer ..... A47B 96/025 211/70
6,811,127 B1 * 11/2004 Shiao ..... B25H 3/04 211/70.6
6,868,975 B2 3/2005 Sells
7,207,450 B1 4/2007 Franklin
7,584,973 B2 * 9/2009 Brager ..... B25H 3/026 108/141

(Continued)

FOREIGN PATENT DOCUMENTS

FR 2515948 A1 * 5/1983 ..... A47F 5/05

*Primary Examiner* — Stanton L Krycinski

(57) ABSTRACT

Provided is a tool storage system that includes one or more tool holders adapted to releasably attach with and hold tools, implements, and the like. The tool storage system further includes a hanger coupled to each tool holder. The hanger is adapted to support the tool holders and each tool holder may be positioned along and may rotate about the hanger to provide ready access to the releasably held tools to a user of the tool storage system. Each tool holder includes a top and a bottom circular plate composed of magnetically permeable material. A magnet configured as a circular plate is interposed between the top and bottom plates of the tool holder. Tools and the like that contain at least a portion of magnetically permeable material are releasable held on the tool holders by magnetic force. Advantageously, the handles of tools releasably held on the tool holders may splay outwardly to make selection of an individual tool easier.

11 Claims, 5 Drawing Sheets

(56) References Cited

U.S. PATENT DOCUMENTS

| | | | | |
|---|---|---|---|---|
| 7,806,548 | B1 * | 10/2010 | Ayala | B25B 11/002 206/350 |
| 8,172,095 | B1 | 5/2012 | Herlihy | |
| 9,095,974 | B2 | 8/2015 | Verson | |
| 9,314,315 | B2 | 4/2016 | Wong | |
| 9,585,476 | B2 * | 3/2017 | Swisher | B25H 1/00 |
| 2006/0243687 | A1 * | 11/2006 | Hilger | A47F 5/02 211/70.6 |
| 2014/0124999 | A1 * | 5/2014 | Foss | B25B 5/003 269/276 |

* cited by examiner

TOOL STORAGE SYSTEM

CROSS-REFERENCE TO RELATED APPLICATIONS

This application claims the benefit of PPA Ser. No. 62/497,931, filed 2016 Dec. 7 by the present inventor, which is incorporated by reference.

DESCRIPTION

BACKGROUND OF THE INVENTION

The systematic storage of requisite tools, implements, work pieces, and the like and their ready accessibility to a user, have been well recognized as a necessity for the efficient performance of construction and production operations. Misplaced items, unavailable for immediate identification and retrieval, represent lost time and other inefficiencies in the carrying out of tasks requiring their use. Further, many individual hobbyists and amateurs involved in the trades, crafts, and arts have similarly recognized the desirability of the systematic storage and retrieval of their "tools-of-the-trade".

Many individuals and entities have obviously attempted to organize routinely utilized tools, implements, and workpieces for efficient storage and retrieval. Some previous tool storage systems utilized peg boards or the like to display and store tools. However these types of devises lack versatility to allow easy reconfiguration or replacement of the tools. Other prior art systems utilized tool chests and the like. These types of systems do not offer ready access to the various tools stored.

There presently remains a need for a simple, inexpensive, adaptable, efficient, and reliable tools storage system that provides ready access to tools and implements and addresses the shortcomings of prior art systems.

SUMMARY OF THE INVENTION

The present invention overcomes the limitations and disadvantages of the prior art. The embodiments disclosed herein are described in the context of a tool storage system for storage and retrieval of tools, implements, workpieces and the like. One of ordinary skill in the art would recognize, however, that the materials and methods disclosed herein will have application in a number of other contexts where general storage and ready convenient access to specific items is desirable, particularly where simplicity and ease of use of a storage system is important.

Further, as used herein, positional terms, such as "top" and "bottom" and the like, and directional terms, such as "up", "down", "horizontal", "outwardly", and the like, are employed for ease of description in conjunction with the drawings. These terms are not meant to indicate that the components of the present invention must have a specific orientation except when specifically set forth below.

In accordance with the principles of the present invention, a tool storage system has been developed that includes one or more tool holders adapted to couple with and securely, but releasably, hold a variety of tools, implements, supplies, workpieces, and the like. In one embodiment, the tool holders releasably secure and hold the various items by magnetic force. In this embodiment, the tool holders each individually include: a first, i.e. a top, plate of magnetically permeable material generally configured in a planar shape; a second, i.e. a bottom, plate similarly composed and configured; and a magnet between the first plate at the top of the tool holder and the second plate at the bottom. In one embodiment, the magnet is coupled to and adjacently contacts both the first and the second plates of the tool holder. In this embodiment, the various tools and the like must each include at least a portion that is magnetically permeable in order for the securing force of the magnet to operate and hold the tools.

The tool storage system in accordance with the principles of the present invention, further includes a hanger coupled to each of the one or more tool holders described above. The hanger of the tool storage system is adapted to support and position the tool holders such that a user of the invention is provided easy and convenient access to the items secured and stored by the system. The hanger has a connection end that provides a means to fixedly attach the hanger and a terminal end opposite the connection end of the hanger. The connection end of the hanger may be attached to a fixed structure such as a ceiling joist by means of straps, sockets, flanged escutcheon plates or junction boxes, threaded support blocks, or other suitable means known in the art.

In one advantageous embodiment of the present invention, both the top and bottom plates of the tool holders are configured as circular plates. In this configuration, the top plate of the tool holder has a first plate diameter and the bottom plate has a second plate diameter which is greater than the first plate diameter of the top plate. Advantageously, in this embodiment, tools attached to tool holders will splay outwardly from the top of the tool holder to its bottom thus providing addition spacing between the stored tool bottom ends to facilitate individual selection of the held tools by a user of the tool storage system.

In other embodiments of the present invention where the items to be held and stored include little or no magnetically permeable material, various other methods of releasable attachment of the tools etc. to the tool holder may be utilized. These method are well known to those of ordinary skill in the art and include but are not limited to releasable adhesives, cooperating attachment means such as clips, barbs, hooks, loops, and fabric fasteners such as Velcro®. Numerous other methods of releasable attachment are well-known in the art and are within the contemplation of the present invention.

In one embodiment of the present invention, all of the tool holders are configured to share a common longitudinal central axis. Said another way, the longitudinal central axes of all of the one or more tool holders are configured to be co-axial. In this embodiment, at least one of the tool holders is longitudinally positionable along and rotatable about this common central axis.

In this embodiment, the hanger supporting and positioning the tool holders may be a simple rod fixedly attached, at the connection end of the hanger, to an elevated stationary horizontal element such as, by way of example, a ceiling joist of a wood or steel framed building. In this configuration the terminal end of the hanger is positioned at a point below the elevated stationary point of attachment of the connection end of the hanger. The tool holders may be longitudinally secured to the rod by any convenient means that provides support of the tool holders positioned along the length of the rod and further provides rotatability of the tool holders when so supported. One well-known example to secure the tool holders is a threaded rod and cooperating thread couplers. Another example is a rod circumferentially notched sequentially along its length and cooperating "c" clips insertable into the notches. Numerous other methods to secure and provide rotatability of the tool holder on the hanger rod are well known in the art and are within the contemplation of the present invention.

In another embodiment of the tool storage system of the present invention, the rod-type hanger supporting the tool holders may be configured to further include a first bend of about 90° along its length thereby defining an arm portion of the hanger on one leg of the bend and a tool holder portion of the hanger on the other. In this configuration, the connection end of the hanger of the tool storage system may he fixedly attached to an elevated vertical stationary element such as a wall stud or surface. When so fixedly attached, the arm portion of the hanger projects outwardly from the fixing vertical stationary element. In this configuration, the tool holder portion of the hanger, it being angularly displaced about 90° from the arm portion of the hanger as described, may be positioned to project vertically downward from the arm portion to present a vertically disposed tool holder portion of the hanger suitable for longitudinally securing one or more rotatable tool holders in the various manners described for a horizontally attached tool holder system.

The arm portion of the hanger in this embodiment may further include another, i.e. and second bend of about 90° proximate the hanger connection end on the arm portion of the hanger thereby defining a pivot point portion from the arm portion of the hanger. The pivot point portion of the hanger, the arm portion of the hanger on the one leg of the first bend, and the tool holder portion on the second leg of the first bend are co-planer. In this co-planer arrangement of the various tool hanger portions, the pivot point portion is vertically disposed. Depending on the orientation of the second bend of the hanger, the pivot point portion leg of second bend of the hanger will extend either upwardly or downwardly. Advantageously, in these configurations the pivot point portion of the hanger may be coupled to a suitable coupler to make the hanger pivotable about the longitudinal axis of the pivot arm portion of the hanger. One type of suitable coupler that provides pivotable attachment of pivot arm portion of the hanger is a pillow block. Strapping the pivot point portion of the hanger to the wall surface or wall stud would also provide pivotability to the pivot point portion of the hanger. Other means to provide pivotability are known in the art. Further, with the pivot point portion of the hanger so attached, the first and second 90° bends and co-planar arrangement of the various hanger portions assures that the tool storage system of the present invention will present a vertically disposed tool holder portion of the hanger suitable for longitudinally securing one or more rotatable tool holders.

These and other features and advantages of the present invention will be more readily apparent from the detailed description set forth below taken in conjunction with the accompanying drawings.

BRIEF DESCRIPTION OF DRAWINGS

The accompanying drawings, which are incorporated in, and constitute a part of this specification, illustrate embodiments of the invention and, together with the description, serve to explain the principles of the invention. In the drawings.

DETAILED DESCRIPTION

It will be appreciated that the description provided is intended only to illustrate and clarify a main preferred embodiment of the present invention. It is in no way meant to limit the scope of the invention, as set forth in the claims.

Figure 1:
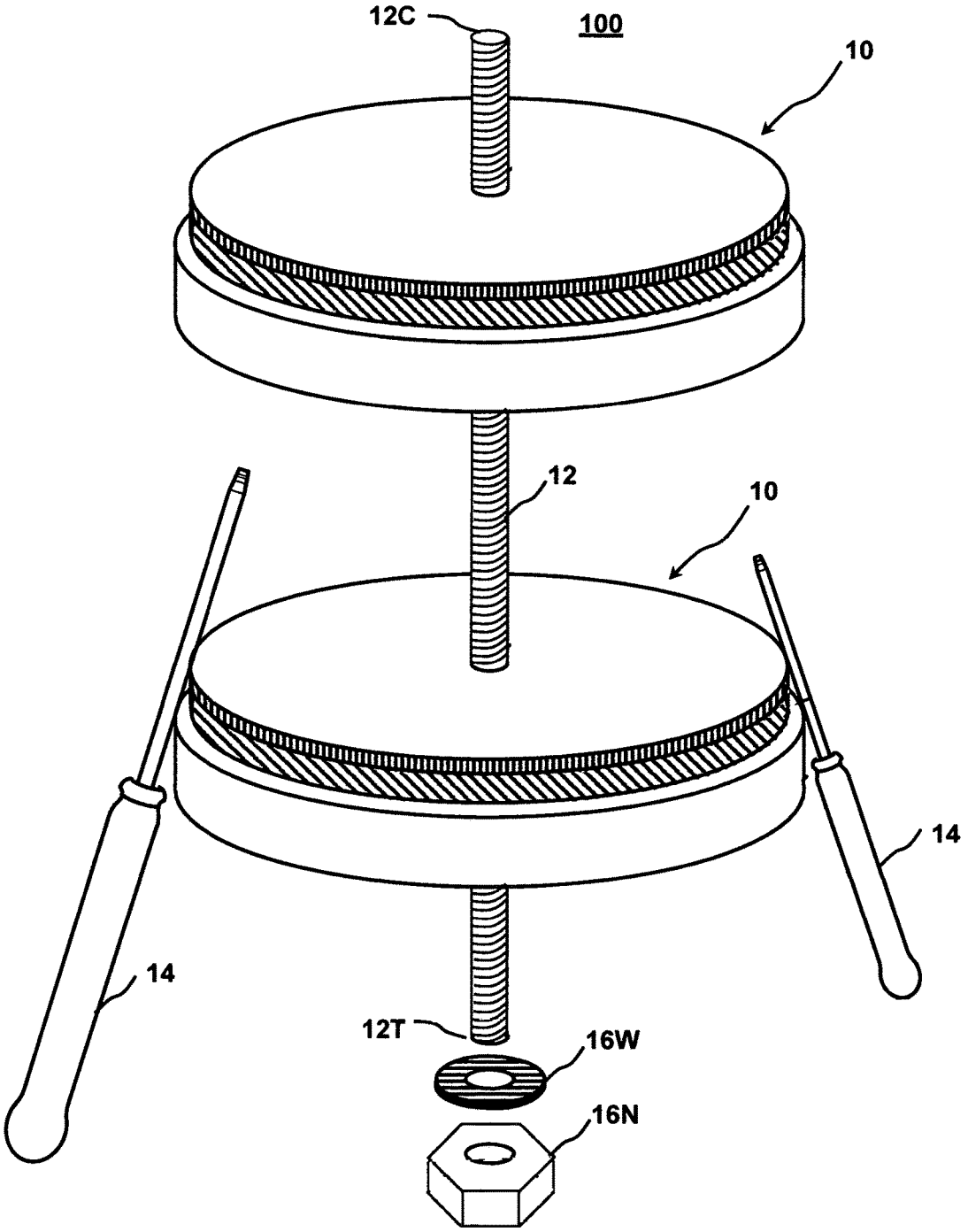
FIG. 1 shows a perspective view of the tool storage system of the present invention.

FIG. 1 shows a perspective view of the tool storage system of the present invention. Referring to FIG. 1, in accordance with the principles of the present invention, a tool storage system 100 includes one or more tool holders 10 coupled to a hanger 12. As described more particularly below with reference to FIGS. 2A and 2B, tool holder 10 includes a top plate 18 and a bottom plate 20. In the embodiment depicted in FIG. 1, two tool holders 10 are shown. Tool storage system 100 may include only one tool holder 10 or may include more than the two tool holders 10 shown in FIG. 1.

As also described more particularly below with reference to FIGS. 2A and 2B, tool holder 10 is adapted to couple with and attach a variety of tools, implements, work pieces, and the like as shown by exemplar screw drivers 14 attached to a tool holder 10 in FIG. 1. For clarity of presentation only a few tools such as screw drivers 14 are shown in the drawings, while at the same time it is to be understood that numerous tools and the like may be held by tool holder 10 circumferentially spaced apart along its peripheral edge. While items such as screw driver 14 are securely held by tool holder 10, a user of tool storage system 100 may remove an item held by the system by grasping the held tool and pulling it away from or otherwise detaching it from tool holder 10. Said another way, tools and the like are releasably held by tool holder 10 and are conveniently available when desired by a user of tool storage system 100.

Further, as described, tool storage system 100 includes hanger 12 that is adapted to support and position tool holder 10 such that a user of the invention is provided easy and convenient access to the items secured and stored by the system. Hanger 12 has a connection end 12C that provides a means to fixedly or pivotably attach hanger 12 to a fixed object, and a terminal end 12T opposite connection end 12C of the hanger 12. Tool holder 10 may be secured longitudinally along hanger 12 by any convenient means that provides support of tool holder 10 positioned along the length of hanger 12. The longitudinal coupling points of the tool holders 10 along hanger 12 may be fixed or independently adjustable. Further, tool holder 10 may be fixedly attached to or, alternately, may be independently rotatable about hanger 12.

In the embodiment of FIG. 1, hanger 12 is depicted as a threaded rod adapted to cooperate with a compatibly threaded tool holder nut 16N such that, when threaded along hanger 12, tool holder nut 16N may be positioned to longitudinally support tool holder 10 at its bottom or, more particularly, at bottom plate 20 (see FIGS. 2A and 2B) of tool holder 10.

If more than one tool holder 10 is used with tool storage system 100, multiple tool holder nuts 16N are used to secure one of each of the multiple tool holders 10 at their respective bottom surfaces. In this embodiment, tool holder 10 is adapter to rotate about hanger 12 as schematically represented by tool holder rotation arrow 27 (See FIGS. 2A and 5). Further, various means are well known to facilitate the rotation of tool holder 10 such as, for example, a smooth low friction washer 16W, or bearings (not shown) interposed between securing tool holder nut 16N and tool holder bottom plate 20 of tool holder 10. As stated, in other embodiments, tool holder 10 may be fixedly attached to a particular point along hanger 12 by, for example, utilizing two tool holder nuts 16N, one threaded and cinched up against top of tool holder 10 and one threaded and cinched up against the bottom of tool holder 10 (See FIG. 5, upper tool holder 10). Other means of fixed or rotatable attachment of tool holder 10 to hanger 12 are well known in the art and are accordingly within the scope of the present invention.

Figure 2A:
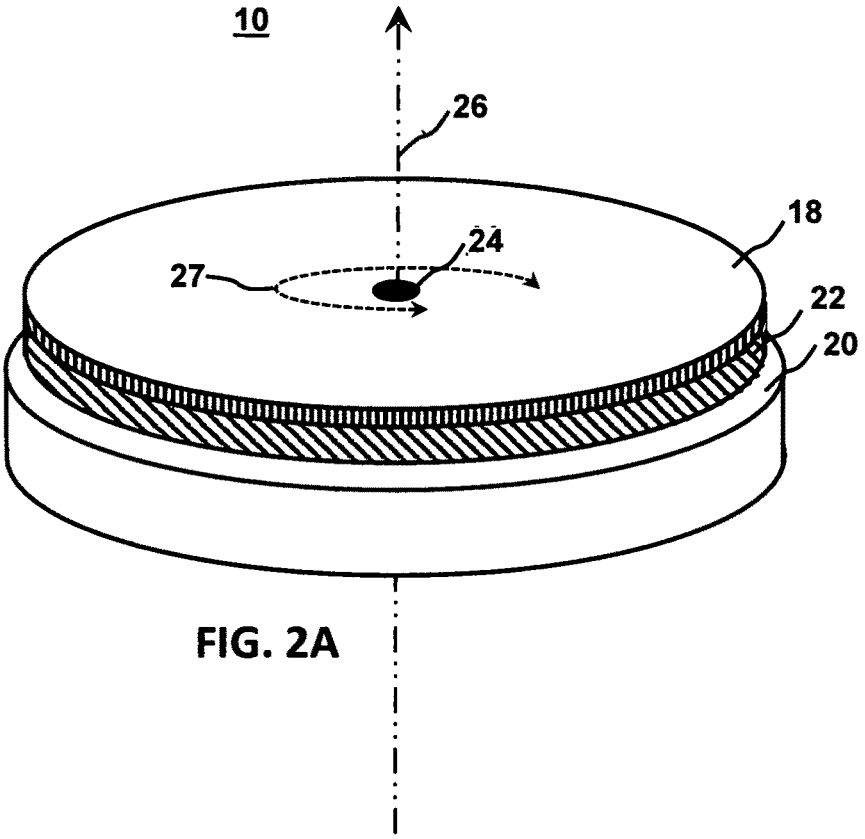
FIG. 2A shows a perspective view of a tool holder of the tool storage system of FIG. 1.

FIG. 2A shows a perspective view of tool holder 10 of tool storage system 100 of FIG. 1. FIG. 2B shows a cross-section view of tool holder 10 shown in FIG. 2A taken through the center of the tool holder. Referring now to FIGS. 1, 2A and 2B together, as described briefly above, tool holder 10 includes a top plate 18 and a bottom plate 20. In one advantageous embodiment of the present invention, both top 18 and bottom 20 plates of tool holder 10 are configured as flat planar circular disks with vertically directed circumferential peripheral edges. Further, top 18 and bottom 20 plates have a common longitudinal central axis 26 and together define a concentric through-hole 24 at the center of both top 18 and bottom 20 plates.

In this embodiment, both top plate 18 and bottom plate 20 are magnetically permeable. Further, in this embodiment, interposed between top plate 18 and bottom plate 20 is a magnet 22, likewise configured as a flat planar circular disk. Further, magnet 22, like top 18 and bottom 20 plates, defines concentric through-hole 24 at its center point. Thus hanger 12 may longitudinally pass through through-hole 24 from the top surface of top plate 18, through top plate 18, through magnet 22, through bottom plate 20 and its bottom surface, whereupon tool holder nut 16N may be threaded on hanger 12 to couple with and longitudinally secure tool holder 10 on hanger 12.

In this embodiment, tool holder 10 releasably secures and holds the various items by magnetic force. Tools, such as screwdriver 14 and the like, must contain at least a portion which is magnetically permeable in order for the securing force of the magnet to operate and hold the tools. Magnetic flux passes from magnet 22 through magnetically permeable top and bottom plates 18, 20 respectively, creating a magnetic force field therein that magnetically couples the magnetically permeable portion of a tool. In one embodiment, magnet 22 is coupled to and adjacently contacts both top and bottom plates 18, 20 of the tool holder 10. Magnet 22 may by coupled to top and bottom plates 18, 20 by any convenient means such as adhesives, screws, or other fasteners.

Figure 2B:
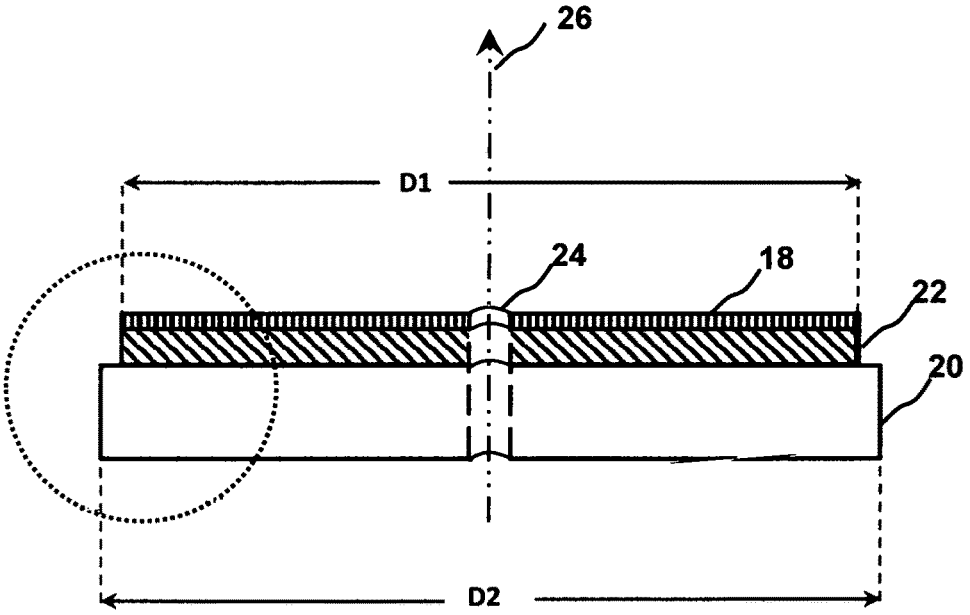
FIG. 2B shows a cross-section view of the tool holder shown in FIG. 2A taken through the center of the tool holder.
Figure 3:
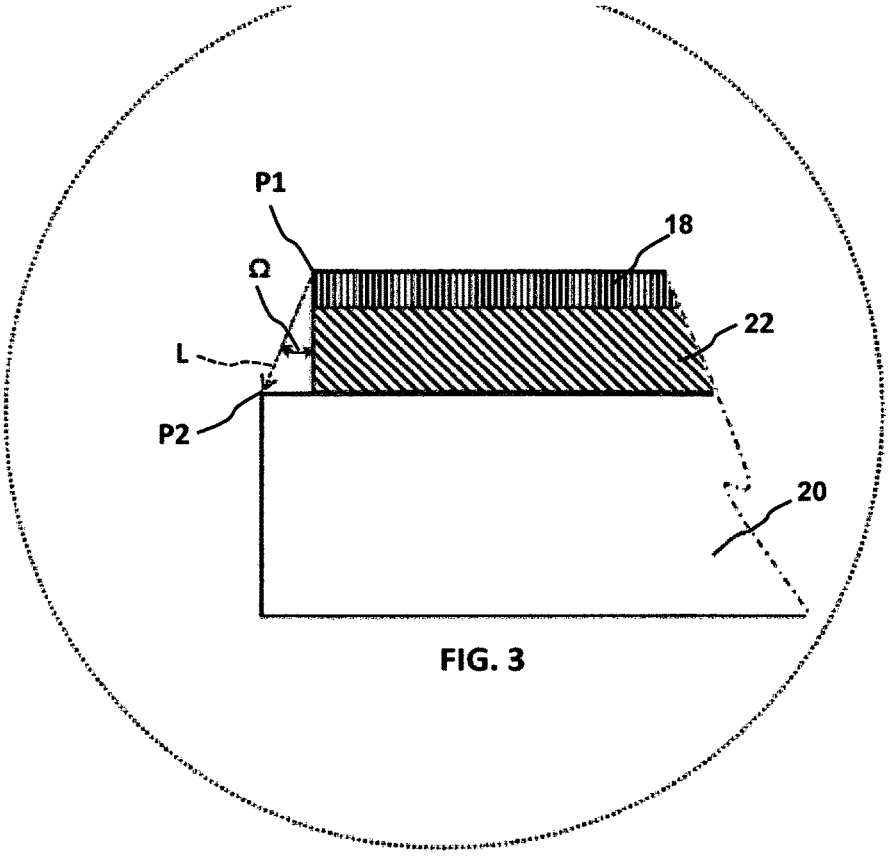
FIG. 3 shows an enlarged view of the area circumscribed in dotted line on the tool holder shown in FIG. 2B.
Figure 4:
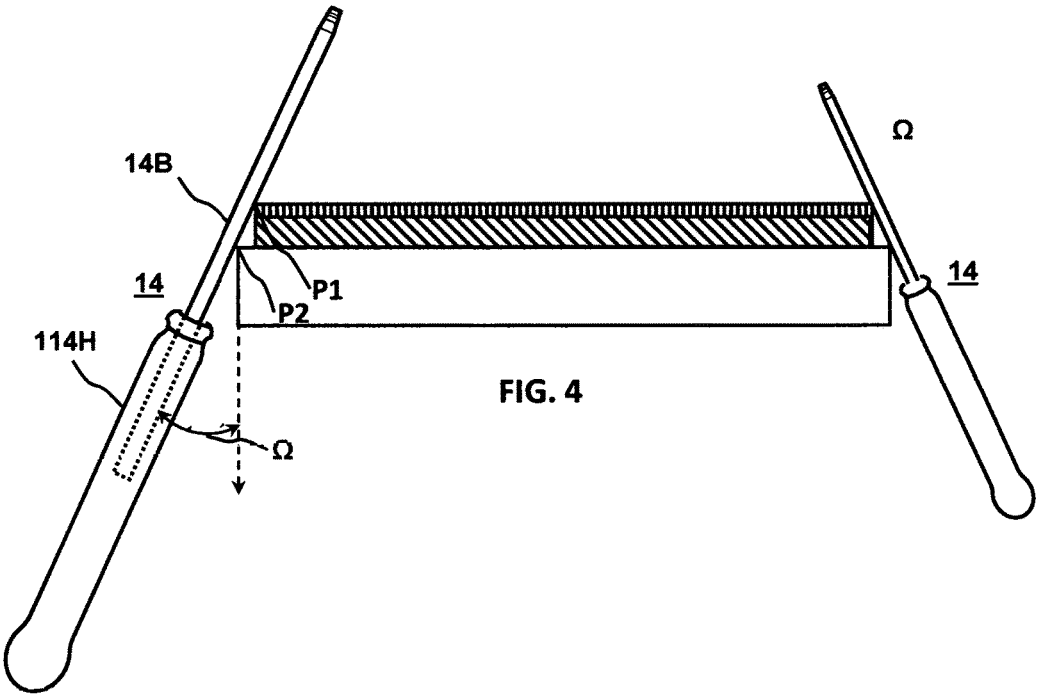
FIG. 4 shows a side view of the tool holder shown in FIG. 2B.

As shown in FIG. 2B, in one embodiment of the present invention, top plate 18 of tool holder 10 has a first, i.e. a top, plate diameter D1 and bottom plate 20 has a second, i.e. a bottom, plate diameter D2 which is greater than top plate diameter D1 of the top plate 18. FIG. 3 shows an enlarged view of the area circumscribed in dotted line on the tool holder shown in FIG. 2B. FIG. 4 shows a side view of tool holder 10 shown in FIG. 2B. Referring now to FIGS. 2B, 3, and 4 together, an imaginary line L is shown between a first, i.e. top point P1 at the top of top plate 18 at a certain circumferential position on the peripheral edge of top plate 18 and a second, i.e. bottom point P2 at a similar circumferential position at the top of bottom plate 20 on its peripheral edge (FIG. 3). Imaginary line L defines an angle Ω with respect to the vertically directed peripheral edges of top 18 and bottom 20 plates (FIG. 3). With this configuration, lower ends of tools and the like, such as screwdriver 14, attached to tool holder 10 will splay outwardly from the top of tool holder 10 to its bottom. Thus as shown in FIG. 4, a vertical splaying angle will be congruent with Ω, it being a corresponding angle with Ω. In one advantageous embodiment, angle Ω is about 19°.

In this embodiment, the splaying of attached tools outwardly from the top to the bottom of tool holder 10 provides addition spacing between the various tool ends to facilitate individual selection of held and stored tools by a user of the present invention. By way of example shown in FIG. 4, screw driver 14 includes a magnetically permeable steel blade end portion 14B and a non-permeable wooden or plastic handle end portion 14H. A user of the present invention who intends to utilize tool storage system 100 would typically pick up screw driver 14 at its handle end portion 14H, move screw driver 14 to tool holder 10 to attach magnetically permeable blade end portion 14B of screw driver 14 to tool holder 10 at first point P1 and second point P2.

Figure 5:
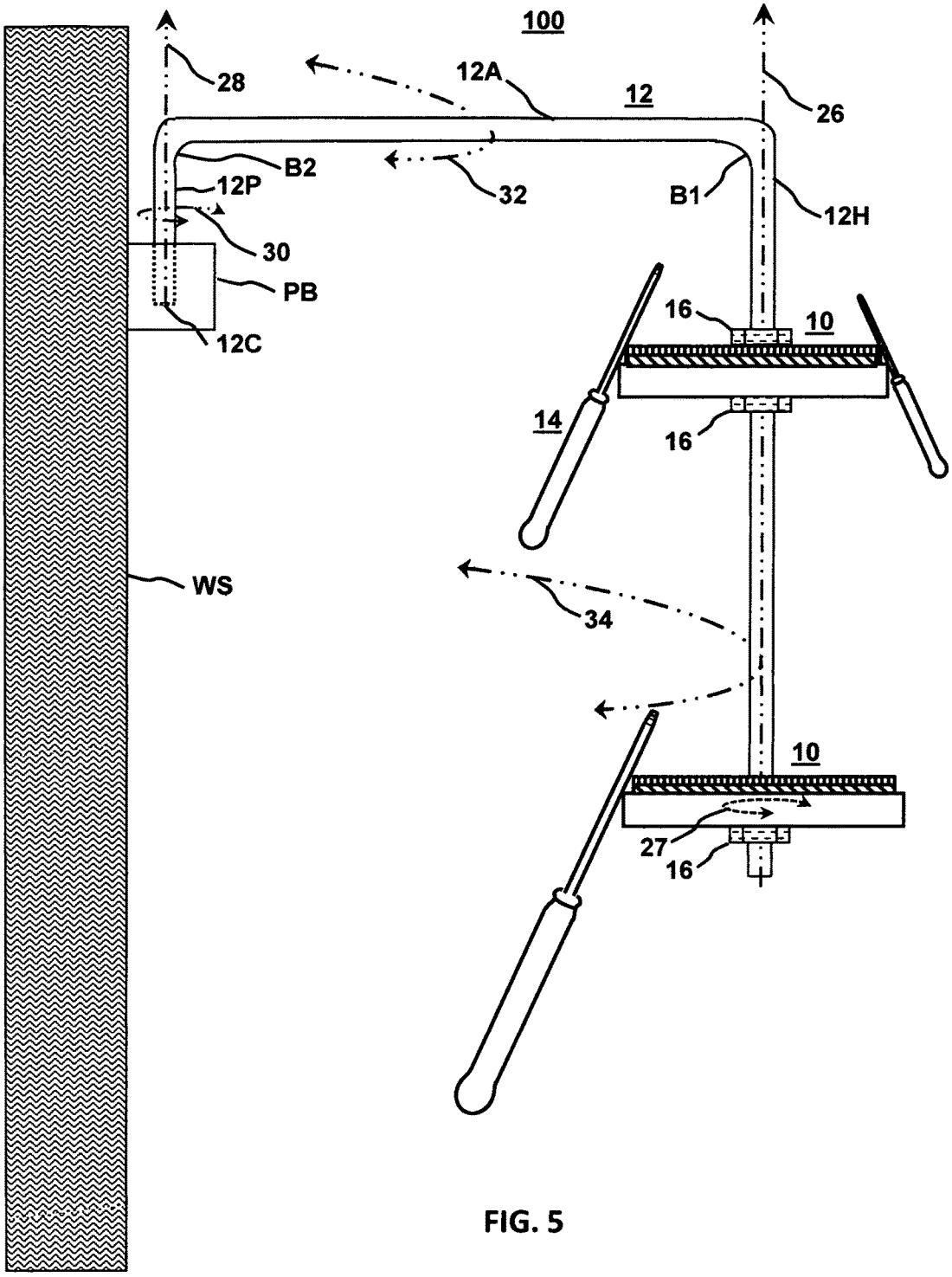
FIG. 5 shows a side view of an embodiment of the tool storage system pivotably attached to a vertical wall surface.

FIG. 5 shows a side view of an embodiment of tool storage system 100 attached to a vertical wall surface. Referring now to FIG. 5, in this embodiment hanger 12 for supporting tool holder 10 is configured to include a first bend B1 of about 90° along its length thereby defining an arm portion 12A of hanger 12 on one leg of first bend B1 and a tool holder portion 12H of the hanger 12 on the other leg.

In this configuration, the connection end 12C of hanger 12 of tool storage system 100 may be fixedly, or as described below pivotably, attached to an elevated vertical stationary element such as, for example, a wall stud WS. When fixedly attached, arm portion 12A of the hanger 12 may be configured as shown in FIG. 5 to project horizontally outward from the fixing vertical stationary element wall stud WS. In this configuration, tool holder portion 12H of hanger 12, it being angularly displaced about 90° from arm portion 12A of hanger 12 as described, may be positioned to project vertically downward from arm portion 12A. Thus, tool holder portion 12H may be made in this embodiment to present a vertically disposed tool holder portion 12H of hanger 12 suitable for longitudinally securing one or more rotatable tool holders 10 by the various means previously described or by other suitable means. Further, the one of more tool holders 10 will be secured to tool holder portion 12H along their coaxial central longitudinal axes 26 as shown in the figure (See also FIG. 2A).

With reference still to FIG. 5, as described above hanger 12 may be attached to wall stud WS pivotably. In this embodiment, hanger 12 further includes another, i.e. a second bend B2 of about 90° along arm portion 12A proximate hanger connection end 12C, thereby defining a pivot point portion 12P from arm portion 12A of hanger 12. In this embodiment, pivot point portion 12P, arm portion 12A, and tool holder portion 12H are configured to be co-planner. In this co-planer arrangement of the various tool hanger portions, pivot point portion 12P is vertically disposed and may be directed either downwardly (as shown in the figure) or upwardly depending of the direction of second bend B2. Said another way, depending on the direction of 90° second bend B2, the vertical pivot point portion leg of second bend B2 with respect to the horizontal arm portion leg of this second bend B2, pivot point portion 12P of hanger 12 will extend vertically upward or alternatively downward.

Advantageously, in these configurations pivot point portion 12P of hanger 12 may be coupled to a suitable coupler to make the hanger pivotable about a longitudinal vertical pivot point central axis 28 of pivot point portion 12P, to present a now vertically disposed tool holder portion 12H of the hanger 12 suitable for longitudinally securing one or more rotatable tool holders 10. For example, in the embodiment in which pivot point portion 12P is downwardly directed as depicted in FIG. 5, a pillow block bearing PB, sometimes also called a plumber block bearing, may be affixed to wall stud WS and pivot point portion 12P is inserted into pillow block bearing PB. For a configuration in which pivot point portion 12P is directed upwardly, pillow block PB may be affixed to an elevated horizontal surface such as a ceiling or ceiling joist. In these and like configurations, pivot point portion 12P may swivel or, more particularly, rotate within pillow block PB as schematically represented by a pivot point portion swivel arrow 30. A user of tool storage system 100 may apply force to arm portion 12A or tool holder portion 12T of holder 12 to cause pivot point portion 12P of hanger 12 to pivot within pillow block PB. In this manner, a user of the tool storage system 100 of the present invention may effectuate movement of arm portion 12A along an arcuate path schematically represented by an arm portion arc arrow 32 and to effectuate movement of tool holder portion 12H and attached tool holders 10 along an arcuate path schematically represented by a tool holder portion arc arrow 34.

The combined capacity of the tool storage system of the present invention to configure tool holders 10 longitudinally along tool holder portion 12H, to provide rotatability to tool holders 10 thus positioned, and provide movement of tool holder 10 along the arcuate path schematically represented by a tool holder portion arc arrow 34, gives great flexibility to a user of tool storage system 100 to easily and conveniently articulate the storage system tool holders and its releasable attached tools to the most efficient spacial location for a given task.

Figure 6:
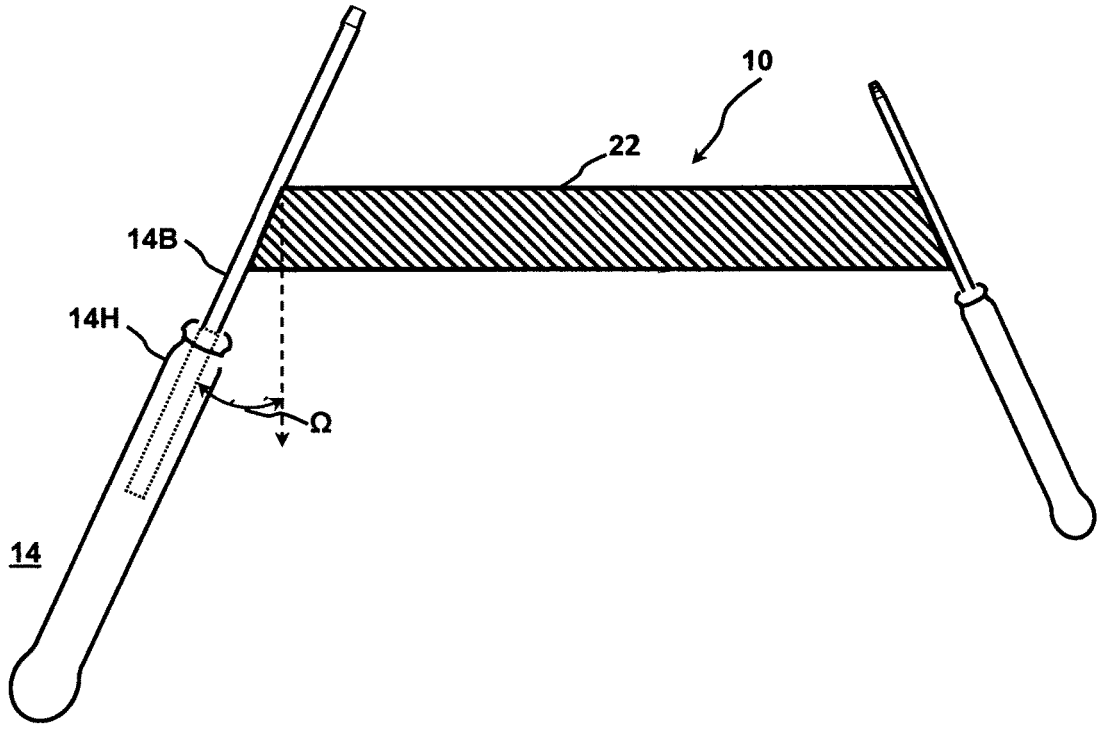
FIG. 6 shows a side view similar to FIG. 4 of another embodiment of the tool holder of the tool storage system of FIG. 1.

Although particular examples herein relating to use of a tool storage system were described for tools and implements, in light of this disclosure, it is understood that the storage system may have use for general storage and organization of other items. The examples were chosen for illustrative purposes only and should not be interpreted to limit the scope of the invention to these specific embodiments. It will be understood by those skilled in the art that various other changes in the form and details may be made without departing from the spirit and scope of the invention. For example, gussets could be added to the bends in the hanger described to strengthen the bends and rigidify them to maintain the 90° described. In another example, the hanger supporting the various tool holders may be attached to a point below the tool holders with a platform base or through-hole in a table or workbench. In yet another example, as shown in FIG. 6, tool holder 10 includes only magnet 22 beveled at its peripheral edge at splaying angle Ω as described above with reference to FIG. 4. In this example, top plate 18 and bottom plate 20 are not included in tool holder 10 (See FIG. 4). Accordingly, the scope of the invention is at least as broad as given by the following claims:

What is claimed is:

1. A tool storage system comprising:

one or more tool holders adapted to releasably attach with and hold tools and implements, wherein said one or more tool holders have coaxial longitudinal axes, said one or more tool holders each individually comprising:

a first magnetically permeable plate;

a second magnetically permeable plate;

a magnet interposed between said first and said second magnetically permeable plates and adjacent both of said first and said second magnetically permeable plates;

wherein both said first magnetically permeable plate and said second magnetically permeable plate are configured as circular plates;

wherein said first magnetically permeable plate has a first plate diameter;

wherein said second magnetically permeable plate has a second plate diameter which is greater than said first plate diameter of said first magnetically permeable plate wherein an imaginary line connecting a first peripheral edge of said first magnetically permeable plate and a second peripheral edge of said second magnetically permeable plate forms a splaying angle with a vertically directed line, said splaying angle configured to allow said tools and implements to splay outwardly from a top of each of said one or more tool holders to a bottom of each of said one or more tool holders when attached to said one or more tool holders, respectively; and a hanger coupled to each of said one or more tool holders, wherein said hanger is adapted to support said one more tool holders.

2. The tool storage system of claim 1, wherein at least one of said one or more tool holders is longitudinally positionable along and rotatable about said coaxial central longitudinal axes of said one or more tool holders.

3. The tool storage system of claim 1 wherein said splaying angle is about 19 degrees.

4. The tool storage system of claim 1, wherein said one or more tool holders further comprise:

a releasable coupling material selected from the group consisting of releasable adhesives, attachment clips, barbs, hooks, loops, and fabric fasteners; each coupling material adapted to cooperate with and releasably attach and hold said tools, and implements.

5. The tool storage system of claim 1:

wherein said hanger has a connection end;

wherein said hanger comprises a rod, said rod being selected from the group consisting of threaded rods, and notched rods.

6. The tool storage system of claim 5, wherein said connection end of said hanger is fixedly attached to a stationary element.

7. The tool storage system of claim 6, wherein said hanger further comprises:

a tool holder portion; and an arm portion angularly displaced by a first bend of about 90 degrees from said tool holder portion.

8. The tool storage system of claim 7 said connection end of said hanger being fixedly attached to said stationary element by a connector selected from the group consisting of straps, sockets, flanged escutcheon plates, junction boxes, and threaded support blocks.

9. The tool storage system of claim 7, wherein said hanger still further comprises:

a pivot point portion proximate said hanger connection end and angularly displaced by a second bend of about 90 degrees from said arm portion of said hanger, and;

wherein said pivot point portion of said hanger, said arm portion of said hanger, and said tool holder portion of said hanger are co-planer.

10. The tool storage system of claim 9 wherein said pivot point portion of said hanger is pivotable about a longitudinal axis of the pivot arm portion of the hanger.

11. The tool storage system of claim 10 further comprising a pillow block bearing attached to said stationary element and having said pivot point portion pivotably coupled to said pillow block bearing.

* * * * *